US008040123B2

(12) United States Patent
Yanagawa

(10) Patent No.: US 8,040,123 B2
(45) Date of Patent: Oct. 18, 2011

(54) REFERENCE VOLTAGE CIRCUIT

(75) Inventor: Kenji Yanagawa, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 749 days.

(21) Appl. No.: 12/175,500

(22) Filed: Jul. 18, 2008

(65) Prior Publication Data

US 2009/0058392 A1 Mar. 5, 2009

(30) Foreign Application Priority Data

Aug. 31, 2007 (JP) ..... 2007-225514

(51) Int. Cl.
*G05F 3/16* (2006.01)

(52) U.S. Cl. ..... 323/313; 323/314; 323/316; 327/538; 327/539

(58) Field of Classification Search ..... 323/311, 323/312, 313, 314, 315, 316, 317; 327/538, 327/539, 540, 541
See application file for complete search history.

(56) References Cited

U.S. PATENT DOCUMENTS

| | | | | |
|---|---|---|---|---|
| 5,856,742 | A * | 1/1999 | Vulih et al. | 323/315 |
| 7,215,183 | B2 * | 5/2007 | Nakada | 327/539 |
| 7,514,987 | B2 * | 4/2009 | Lin | 327/539 |
| 7,532,063 | B2 * | 5/2009 | Lee | 327/539 |

FOREIGN PATENT DOCUMENTS

JP 2004206633 7/2004

* cited by examiner

*Primary Examiner* — Adolf Berhane
*Assistant Examiner* — Nguyen Tran
(74) *Attorney, Agent, or Firm* — Volentine & Whitt, PLLC

(57) ABSTRACT

A reference voltage circuit that obtains a precisely constant voltage by compensating a temperature variation of a reference voltage circuit using band gap voltage. A p-type MOS transistor (PNP) outputs a reference voltage according to a control voltage, and provides respective PNPs having diode connections with currents corresponding to the reference voltage. A temperature compensation unit adds compensation currents proportional to the second power of absolute current to currents flowing in the respective PNPs, so that both voltages generated corresponding to the currents flowing in the respective PNPs become the same in the case where the band gap unit has temperature characteristics including a peak value. The band gap unit has a differential amplifier for outputting the control voltage. In the case where the band gap unit has a bottom value, the compensation unit subtracts the above compensation currents from the currents flowing in the respective PNPs.

13 Claims, 6 Drawing Sheets

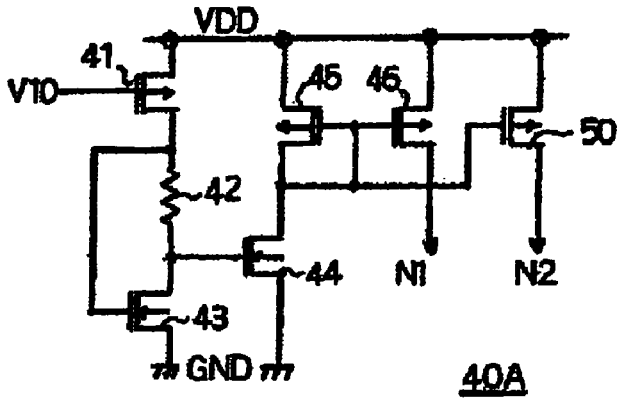
Fig. 8
Fig. 9A
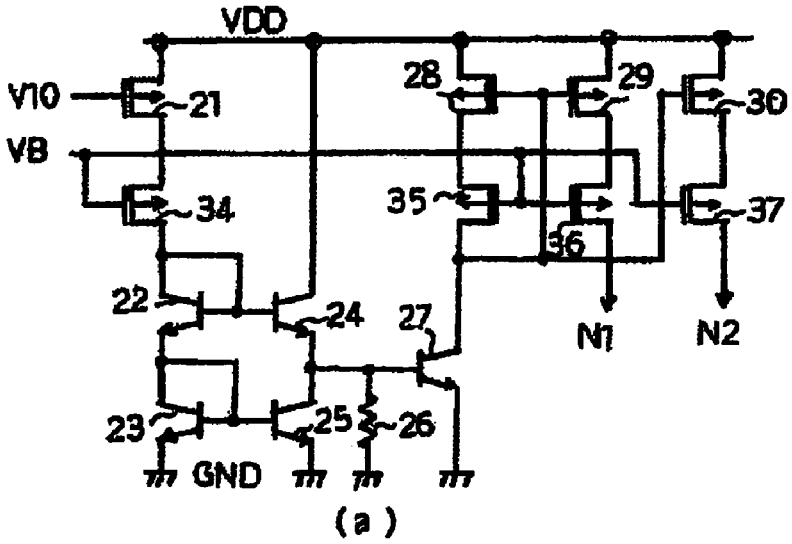
Fig. 9B
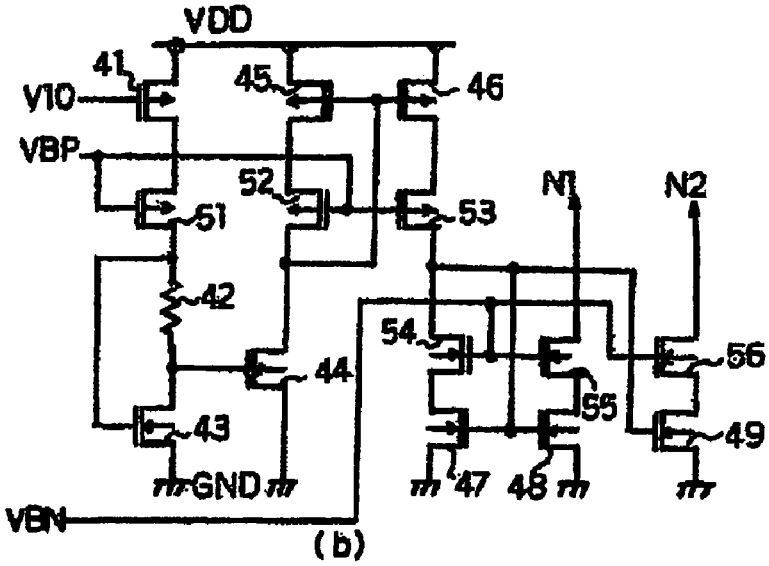

REFERENCE VOLTAGE CIRCUIT

The present application claims priority under 35 U.S.C. 119 to Japanese patent application serial number 225514/2007, filed on Aug. 31, 2007, which is hereby incorporated by reference in its entirety for all purposes.

BACKGROUND OF THE INVENTION

1. Field of the Invention

The present invention relates to a reference-voltage circuit using a band-gap voltage, and more particularly to temperature compensation thereof.

2. Description of the Related Art

FIG. 2A is a view of a conventional band-gap circuit, and FIG. 2B shows temperature characteristics of an output voltage of the conventional band-gap circuit shown in FIG. 2B. The band-gap circuit shown in FIG. 2A consists of PNP-type bipolar transistors (hereinafter referred to as 'PNP') 1 and 2; resistors 3, 4 and 5; and a differential operational amplifier 6. A base and a collector of the PNP 1 are connected to ground, and an emitter is connected to an inverting input terminal of the differential operational amplifier 6. In addition, a base and a collector of the PNP 2 are connected to ground, and an emitter is connected to a non-inverting input terminal of the differential operational amplifier 6 through the resistor 5. An output terminal of the differential operational amplifier 6 is connected to the inverting input terminal through the resistor 3 and the non-inverting input terminal through the resistor 4 as well. Furthermore, a constant voltage VBG is output from the output terminal of the differential operational amplifier 6.

If the base-emitter voltage of the PNP 1 shown in FIG. 2A is defined as VBE, resistances of the resistors 3, 4 and 5 are defined as R3, R4 (=m×R3) and R5 respectively, and the area ratio between PNP 1 and the PNP 2 is 1:n, then the output voltage VBG may be represented by the following equation:

$$VBG=VBE+mXR3/R5\times VTX \quad (1).$$

In equation (1), VT is thermoelectric voltage (=kT/q, wherein k is Boltzmann constant, T is absolute temperature, and q is electric charge) and has a positive temperature coefficient of around 0.0086 mV/° C. Also, X=m×n. Meanwhile, VBE as the first term of equation (1) has a negative temperature coefficient of around −2 mV/° C. Therefore, an output voltage independent from the temperature can be obtained by setting m, n, R3 and R5 so that the first and second terms of equation (1) cancel each other.

However, the base-emitter voltage VBE of a transistor used in practical circuits includes a nonlinear component in its temperature characteristics, so that the temperature coefficient is not constant. Therefore, the output voltage VBG of a practical band gap circuit has curved temperature characteristics including a peak value or a bottom peak, as shown in FIG. 2B. In addition, the issue of whether the temperature has a peak value or a bottom value depends on the production process of transistors and resistors composing the circuit.

SUMMARY OF THE INVENTION

In order to solve the above problems, it is an object of the present invention to obtain a precisely constant voltage by compensating a temperature variation of an output voltage from a reference voltage circuit by using a band gap voltage.

A reference voltage circuit of the present invention is characterized by including a current source, a band gap unit, and a temperature-compensating unit. The current source outputs a reference voltage according to a control voltage and provides a current corresponding to the reference voltage to first and second junction-type semiconductor devices. The band gap unit has a differential amplifier for outputting the control voltage so that a voltage generated based on the current of the first junction-type semiconductor device and a voltage generated based on the current of the second junction-type semiconductor device becomes the same. The temperature-compensating unit adds a compensation current to the currents of the first and the second junction-type semiconductor devices, the compensation current being generated responsive to the control voltage and proportional to the second power of the absolute temperature. In addition, in the case where the band gap unit has temperature characteristics including a bottom value, the temperature-compensating unit is configured to subtract the compensation current from the currents of the first and the second junction-type semiconductor devices.

According to the present invention, the compensation current proportional to the second power of the absolute temperature is added to or subtracted from the current of the junction-type semiconductor device corresponding to the characteristics of the band gap unit. Consequently, temperature variation of the output reference voltage can be compensated by adjusting the voltage of the junction region of the junction-type semiconductor device correspondingly to the temperature, and there is an effect that a precisely constant voltage can be obtained.

BRIEF DESCRIPTION OF THE DRAWINGS

The above and other aspects and features of he present invention will become readily apparent from the detailed description that follows, with reference to the accompanying drawings, in which:

FIG. 8 is a configuration diagram of a temperature compensation unit according to the fourth embodiment of the present invention; and FIGS. 9A and 9B are configuration diagrams of temperature compensation units of further embodiments of the present invention.

DESCRIPTION OF THE PREFERRED EMBODIMENTS

The above mentioned and other objectives of the present invention, and the novelty of the present invention, will become more thoroughly clear in view of the following description of the preferred embodiments referring to the accompanying drawings. However, the drawings are used only for explanation, and are not intended to limit the scope of the present invention.

Figure 1:
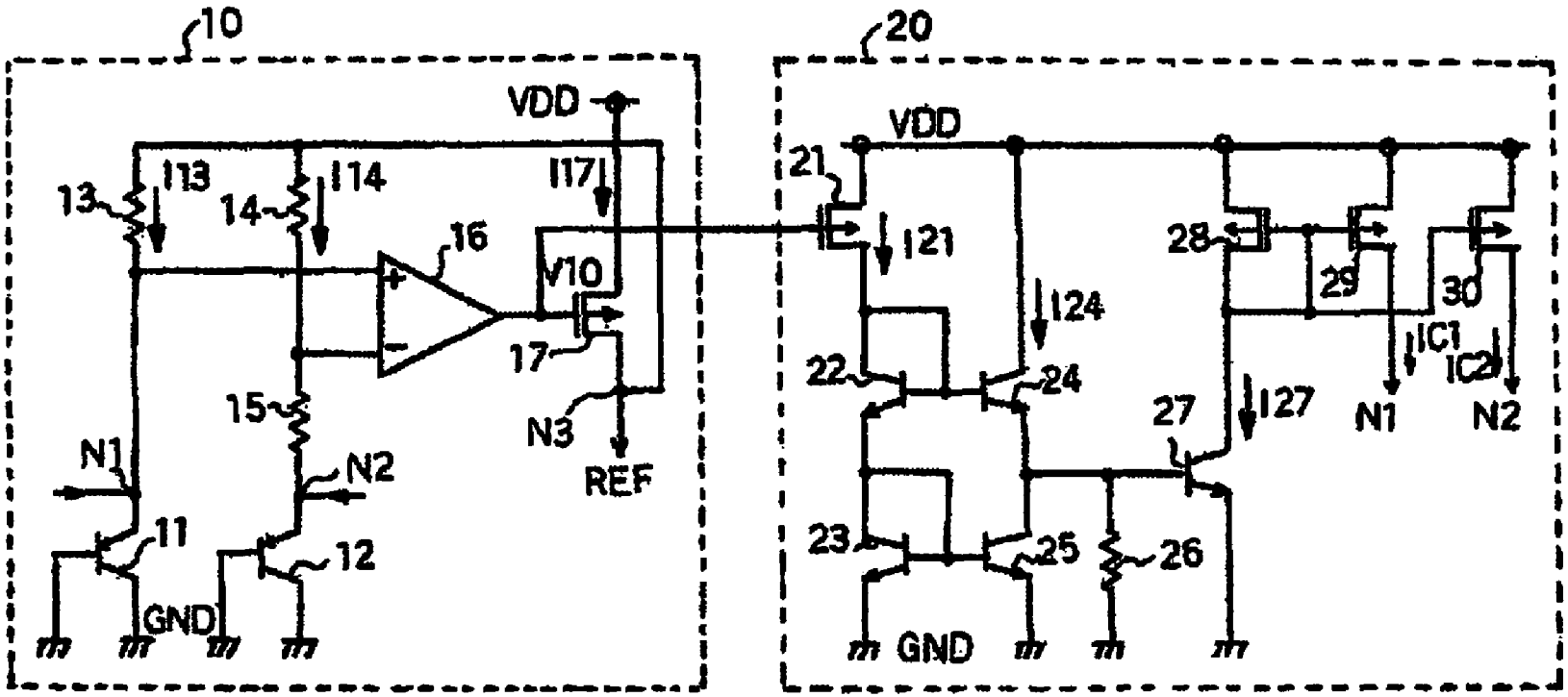
FIG. 1 is a configuration diagram of a reference voltage circuit according to the first embodiment of the present invention.
Figure 2A:
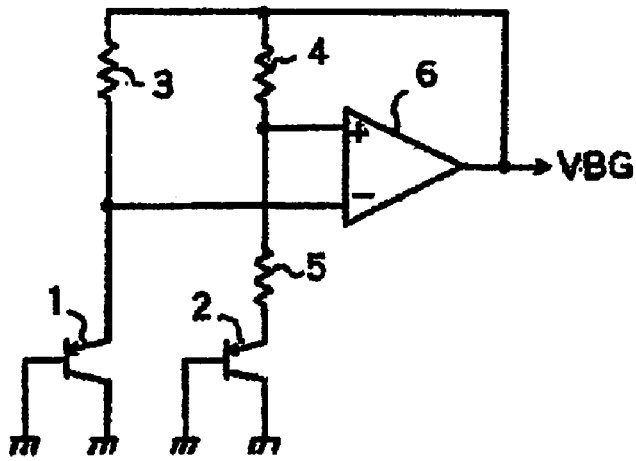
Fig. 2A PRIOR ART
FIGS. 2A and 2B are views descriptive of a conventional band gap circuit.
Figure 2B:
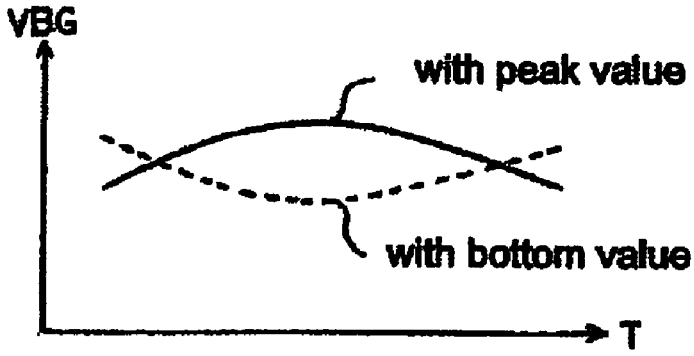
Fig. 2B PRIOR ART

FIG. 1 is a configuration diagram showing a first embodiment of the present invention. The reference voltage circuit consists of a band gap unit 10 and a temperature compensation unit 20. The band gap unit 10 has almost the same configuration as shown in FIG. 2A, and consists of PNP-type bipolar transistors (hereinafter referred to as "PNP") 11 and 12 of junction-type semiconductor devices having diode-junctions; resistors 13, 14 and 15; a differential amplifier 16, and a P-channel MOS transistor (hereinafter referred to as "PMOS") 17 as a current source. A base and a collector of the PNP 11 are connected to ground, and an emitter thereof is connected to a node N1, whereby node N1 is connected to a non-inverting input terminal of the differential amplifier 16. In addition, a base and a collector of the PNP 12 are connected to ground, and an emitter thereof is connected to the node N2, whereby the node N2 is connected to the inverting input terminal of the differential amplifier 16 through resistor 15. A control voltage V10 output from an output terminal of the differential amplifier 16 is provided to a gate of the PMOS 17 and also to the temperature compensation unit 20. A source of the PMOS 17 is connected to the power supply VDD, and a drain thereof is connected to a node N3. The node N3 is connected to the non-inverting terminal of the differential amplifier 16 through the resistor 13, and to the inverting terminal of the differential amplifier 16 through the resistor 14. Furthermore, a constant output voltage REF is output from node N3 as a reference voltage.

The temperature compensation unit 20 shown in FIG. 1 performs temperature compensation of the band gap unit 10 in the case where the band gap unit 10 has curved temperature characteristics including a peak value. The temperature compensation unit 20 consists of PMOSs 21 and 28 to 30; NPN-type bipolar transistors (hereinafter referred to as "NPN") 22 to 25 and 27; and a resistor 26. A gate of the PMOS 21 is provided with the control voltage V10, a source thereof is connected to a power supply VDD, and a drain thereof is connected to a collector and a base of the NPN 22 and a base of the NPN 24. A collector of the NPN 24 is connected to the voltage VDD, an emitter thereof is connected to a collector of the NPN 25 and a base of the NPN 27, and the emitter thereof is also connected to ground through the resistor 26. An emitter of the NPN 27 is connected to ground, and a collector thereof is connected to the power supply VDD through the PMOS 28. Furthermore, the collector of the NPN 27 is connected to gates of the PMOSs 28, 29 and 30. Sources of the PMOSs 29 and 30 are connected to the power supply VDD, and drains thereof are connected to nodes N1 and N2 respectively. Compensation currents IC1 and IC2 are provided from the drains of PMOSs 29 and 30 respectively to the nodes N1 and N2 of the band gap unit 10. Also, an emitter of the NPN 22 is connected to a collector and a base of NPN 23, and a base of the NPN 25. Emitters of NPNs 23 and 25 are connected to ground.

FIGS. 3A-3D are views of temperature characteristics of each part in FIG. 1. The operation of the reference voltage circuit of FIG. 1 will be explained as follows, referring to FIGS. 3A-3D. First, operation of the band gap unit 10 will be explained. If the base-emitter voltage of PNP 11 is defined as VBE; resistances of the resistors 13, 14 and 15 are defined as R3, R4 (=m×R3) and R5 respectively; and the area ratio of the PNPs 11 and 12 is 1: n, then an output voltage VBG of the band gap unit 10 can represented by previously described equation (1). In addition, if currents flowing in the resistors 13 and 14 are defined as I13 and I14 respectively, then I13 and I14 may be represented by the following equation:

$$I13=m/R5\times VT\times 1n(m\times n)=m\times I14 \quad (2).$$

Consequently, current I17 flowing in the PMOS 17 may be represented by the following equation:

$$I17=I13+I14=(m+1)/R5\times VT\times 1n(m\times n) \quad (3).$$

In the formula (3), m is a resistance ratio of the resistors 13 and 14, n is an area ratio of the PNPs 11 and 12, and the above values are constant independently from the temperature. Therefore, a current I17 becomes a temperature-proportional current IPATAT.

However, the above-mentioned equations (1) to (3) are equations for an ideal case where each of the elements is ideal. In the case of practical elements for example, the base-emitter voltages VBE of the PNPs 11 and 12 include characteristics varying with temperature non-linearly. For this reason, the characteristics of the current I17 and the base-emitter voltage VBE shift from the ideal characteristics at higher and lower temperature regions, as shown by the broken lines in FIGS. 3A and 3B. Consequently, the output voltage REF varies with temperature and includes a peak value at a certain temperature, and then the output voltage REF has values lowering with temperature as shown by the broken line in FIG. 5D.

Operation of the temperature unit 20 will be explained as follows with further reference to FIG. 1. Since a gate of the PMOS 21 has applied thereto the control voltage V10 that is the same voltage as the gate voltage of the PMOS 17 in the band gap unit 10, a current I21 flowing in the above PMOS 21 becomes the temperature proportional current IPTAT. Meanwhile, if base-emitter voltages of NPNs 22 to 25 and 27 are defined as VBEs 22 to 25 and 27 respectively, then the following equations can be used with respect to the NPNs 22 to 25 and 27:

$$VBE22+VBE23=VBE24+VBE27 \quad (4), \text{ and}$$

$$VBE+VT\times 1n(IC/IS) \quad (5).$$

In the case of equation (5), collector current is defined as IC and saturation current is defined as IS.

A current value that is the same as the current I21 that flows in the PMOS 21 as shown in FIG. 1 thus flows in the NPN 23 as well. When the currents flowing in the NPNs 24 and 27 are defined as I24 and I27 respectively, and the equation (5) is substituted into the equation (4), then the following equation can be obtained:

$$\begin{aligned} VBE\ 22 + VBE\ 23 &= 2\times VT\times \ln(I21/IS) \\ &= VT\times \ln(I24/IS) + VT\times \ln(I27/IS). \end{aligned} \quad (6).$$

If the above equation is solved for I27, the current I27 can be expressed by the following equation:

$$I27=(I21)\times 2/I24 \quad (7).$$

If an area ratio of the NPNs 23 and 25 is 1:N, a resistance of the resistor 26 is defined as R26, and the base current of the NPN 27 can be neglected, then the current I24 can be expressed by the following equation:

$$I24=I21/N+VBE27/R26 \quad (8).$$

Figure 3A:
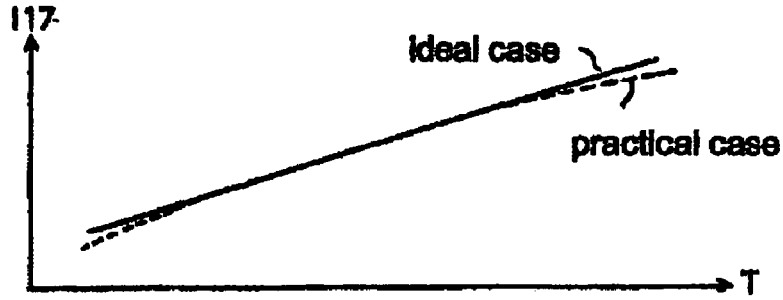
FIGS. 3A-3D are views of temperature characteristics of each part in FIG. 1.
Figure 3B:
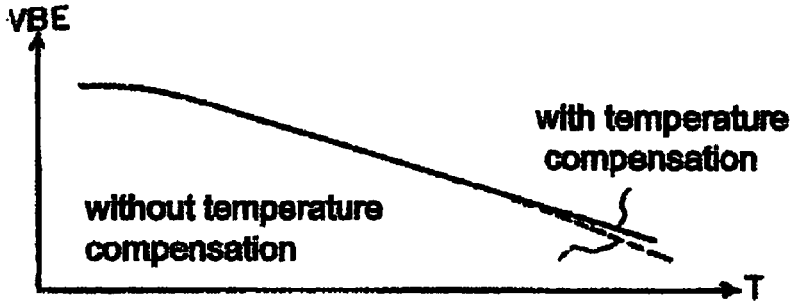
Figure 3C:
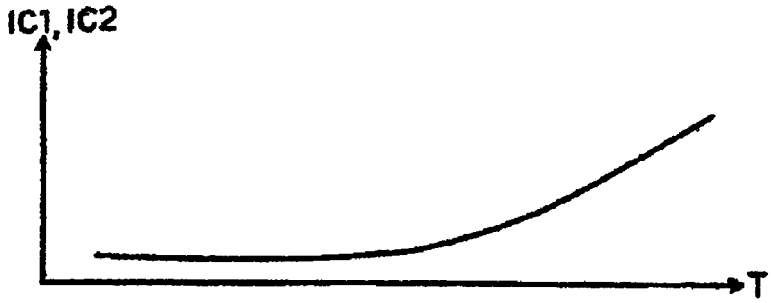
Figure 3D:
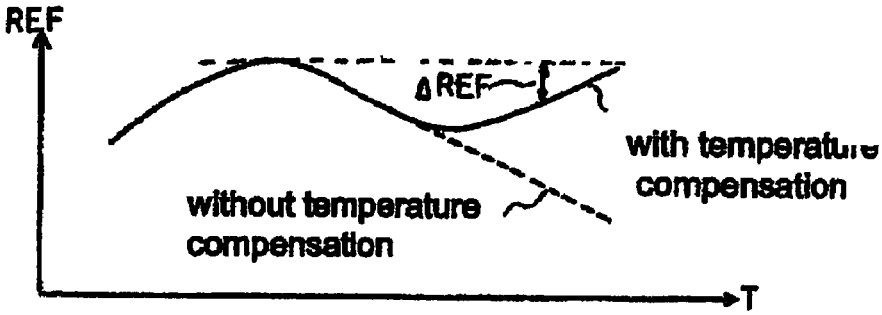

Since VBE 27 has a negative temperature coefficient, and the current I21 is a temperature-proportional current IPTAT, if the values of N and the resistance of the R26 are set appropriately, then the current I24 can be set to a current independent from the temperature. In the above case, the current I27 becomes a current proportional to the second power of the current I21. The current I27 is copied by the PMOSs 28, 29 and 30 which are configured as a current mirror, and is applied to the nodes N1 and N2 of the band gap unit 10 as compensation currents IC1 and IC2. The compensation currents IC1 and IC2 have temperature characteristics proportional to the second power of absolute temperature, as shown in FIG. 3C.

In the band gap unit 10 shown in FIG. 1, currents of the PNPs 11 and 12 are respectively increased by the compensation currents applied to the nodes N1 and N2, and the base-emitter voltages VBE11 and VBE12 are increased. Consequently, the output voltage REF rises. Therefore, when the compensation currents IC1 and IC2 increase as the temperature rises, the output voltage REF rises, and then the output voltage error ΔREF becomes smaller.

As explained before, a reference voltage circuit according to the first embodiment includes the temperature unit 20 for outputting the compensation currents IC1 and IC2 proportional to the second power of the temperature-proportional current IPTAT, and the temperature compensation unit 20 applies the above compensation currents IC1 and IC2 to the PNPs 11 and 12 of the band gap unit 10. Consequently, the base-emitter voltage VBE of the PNPs 11 and 12 increase as the temperature rises, and then the drop of the output voltage REF can be reduced. Therefore, the temperature variation of the output voltage REF can be compensated, and then there is an advantage that a precisely constant voltage can be obtained.

Figure 4:
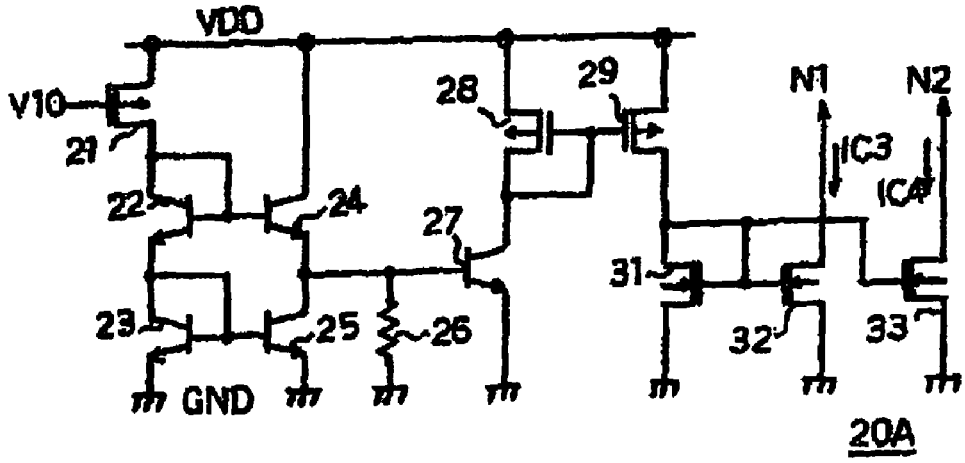
FIG. 4 is a configuration diagram of a temperature compensation unit according to the second embodiment of the present invention.

FIG. 4 is a configuration diagram of a temperature compensation unit of a second embodiment of the invention. The compensation unit 20A replaces the temperature compensation unit 20 in FIG. 1, and is for carrying out the temperature compensation in the case where the band gap unit 10 has curved temperature characteristics including a bottom value. In FIG. 4, the elements identical to the ones in FIG. 1 are provided with the same numerals as in FIG. 1, and explanation of such identical elements is here omitted.

The temperature compensation unit 20A in FIG. 4 includes N channel type MOS transistors (hereinafter referred to as "NMOS") 31, 32 and 33 instead of the PMOS 30 of the temperature compensation unit 20 in FIG. 1. A drain of the NMOS 31 is connected to a drain of the PMOS 29, and a source of the NMOS 31 is connected to ground. Furthermore, a gate of the NMOS 31 is connected to a drain of the PMOS 29, as well as the gates of the NMOSs 32 and 33. Sources of the NMOSs 32 and 33 are connected to ground, and drains of the NMOSs 32 and 33 are connected to nodes N1 and N2 of the band gap unit 10.

In the above temperature compensation unit 20A shown in FIG. 4, compensation currents IC3 and IC4 proportional to the second power of absolute temperature flow into the NMOSs 32 and 33 respectively from the nodes N1 and N2 in the opposite direction to the temperature compensation unit 20 in FIG. 1. As a result, currents I13 and I14 of the PNPs 11 and 12 of the band gap unit 10 are reduced by the values of the compensation currents IC3 and IC4. Consequently, base-emitter voltages VBE of the PNPs 11 and 12 are reduced as the temperature rises, and then the rising of the output voltage REF can be reduced. Therefore, there is an advantage that the temperature variation of the output voltage REF can be compensated and a precisely constant voltage can be obtained. In addition, whether the temperature characteristics of the band gap unit 10 has a bottom value or a peak value can be proved by a simulation during designing. Therefore, whether the above-mentioned temperature compensation unit 20A of the second embodiment or the temperature compensation unit 20 of the first embodiment needs to be adopted can be determined according to the temperature characteristics.

Figure 5:
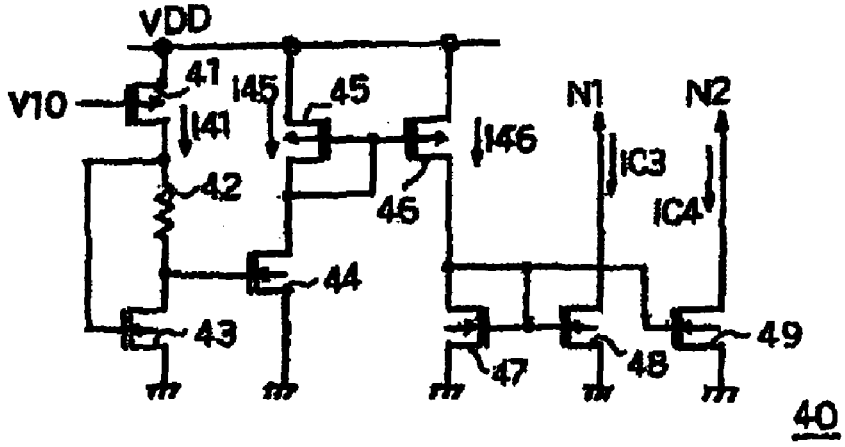
FIG. 5 is a configuration diagram of a temperature compensation unit according to the third embodiment of the present invention.

FIG. 5 is a configuration diagram of a temperature compensation unit according to the third embodiment of the invention. The temperature compensation unit 40 replaces the temperature compensation unit 20 in FIG. 1, and in the case of where the band gap unit 10 has curved temperature characteristics including a peak value, the temperature compensation unit 40 carries out temperature compensation for the band gap unit 10.

Non-linear temperature characteristics of bipolar transistors influence the output voltage thereof not only at higher temperatures, but also at lower temperatures. The temperature compensation unit 20 of the first embodiment improves the precision of the output voltage REF by carrying out the temperature compensation at higher temperatures, but does not carry out the compensation at lower temperatures. In addition, the temperature compensation unit 20 consists of NPNs. However, NPNs are not included in some P-substrate-type CMOS processes, and thus the configuration of FIG. 1 cannot be applied to P-substrate type CMOS processes. The temperature compensation unit 40 shown in FIG. 5 is configured without NPNs, and makes it possible to carry out temperature compensations at both higher and lower temperatures.

The temperature compensation unit 40 of FIG. 5 consists of PMOSs 41, 45 and 46; NMOSs 43, 44 and 47 to 49; and resistor 42. A gate of the PMOS 41 has the control voltage V10 of the band gap unit 10 applied thereto, a source thereof is connected to the power supply VDD, and a drain thereof is connected to ground at a drain of the NMOS 43 through the resistor 42. A gate of the NMOS 43 is connected to a drain of the PMOS 41, a drain of the NMOS 43 is connected to a gate of the NMOS 44, and a source of the NMOS 43 is connected to ground. A source of the NMOS 44 is connected to ground, and a drain thereof is connected the power supply VDD through the PMOS 45. A gate of the PMOS 45 is connected to a drain of the NMOS 44, as well as a gate of the PMOS 46. A source of the PMOS 45 is connected to the power supply VDD. A drain of the NMOS 47 is connected to a drain of the PMOS 46, and a source of the NMOS 47 is connected to ground. In addition, a gate of the NMOS 47 is connected to a drain of the PMOS 46, as well as gates of the NMOSs 48 and 49. Sources of the NMOSs 48 and 49 are connected to ground, and drains of the NMOSs 48 and 49 are respectively connected to the nodes N1 and N2 of the band gap unit 10.

Figure 6:
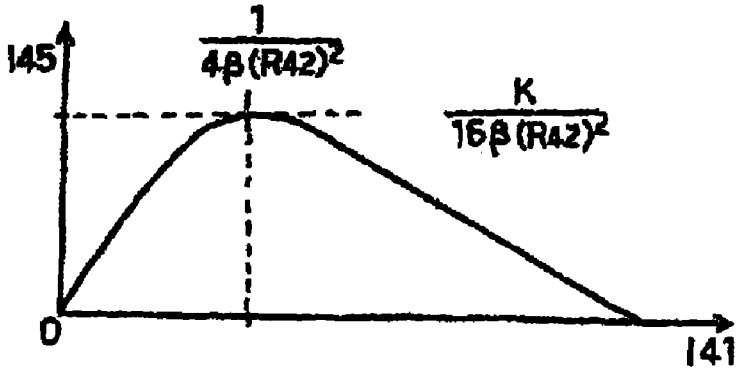
FIG. 6 is a view of circuit characteristics of FIG. 5.

FIG. 6 is a view of the circuit characteristics and FIGS. 7A-7D are views of the temperature characteristics of each unit in FIG. 5. Operation of the temperature compensation unit 40 of FIG. 5 will be explained as follows, referring to FIG. 6 and FIG. 7. If currents flowing in the PMOSs 41, 45 and 46 are respectively defined as I41, I45 and I46, a dimension (gate width/gate length) ratio is defined as K, and the NMOSs 43 and 44 operate in a saturation region, then the currents I41 and I45 flowing in the NMOSs 43 and 44 may be represented by the following equations:

$$I41=\beta\times(VGS43-VT)\times 2 \quad (9), \text{ and}$$

$$I142=K\times\beta\times(VGS44-VT)\times 2 \quad (10).$$

In the above equations (9) and (10), β is a constant given by (½)×μ×COX×W/L, whereby μ is electron mobility and COX is capacitance per area unit of the gate oxide film, and VGSs 43 and 44 are respective gate-source voltages of the NMOSs 43 and 44.

In addition, if a value of the resistor 42 in FIG. 5 is defined as R42, then the VGSs 43 and 44 may be represented by the following equation:

$$VGS43=VGS44+R42+I41 \quad (11).$$

The current I45 is represented by the following equation, using the equations (9) to (11):

$$I45=K\times\beta\times(R42)2\times I41\times(\sqrt{I41}-1/(R42\times\sqrt{\beta}))2 \quad (12).$$

In the above equation, $I41 \leqq 1/(\beta\times(R42)2)$. If equation (12) is differentiated by I42, and dI45/dI41=0 is solved for I41, then the following equation is obtained:

$$I45=1/(4\beta\times(R42)2),1/(\beta\times(R42)2 \quad (13).$$

The calculations described before makes it clear that the current I45 has a peak value expressed by the following equation in the case of I41=1/(4β×(R 42)2):

$$I45=K/(16\beta\times(R42)2) \quad (14).$$

Figure 7A:
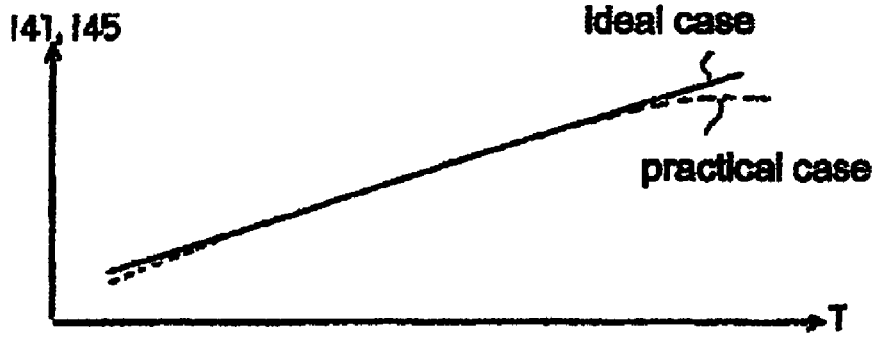
FIGS. 7A-7D are views of temperature characteristics of each part in FIG. 5.
Figure 7B:
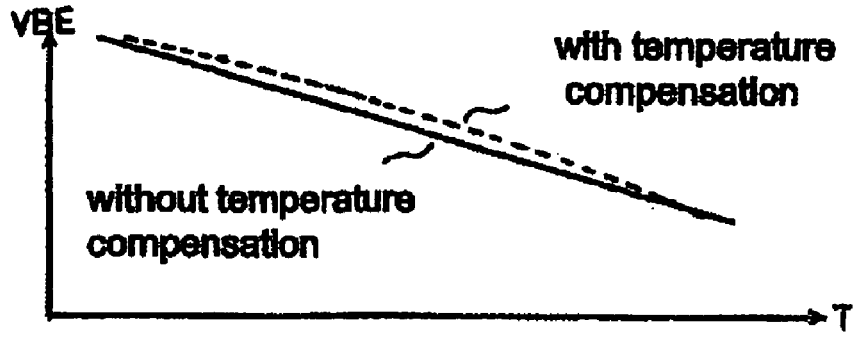
Figure 7C:
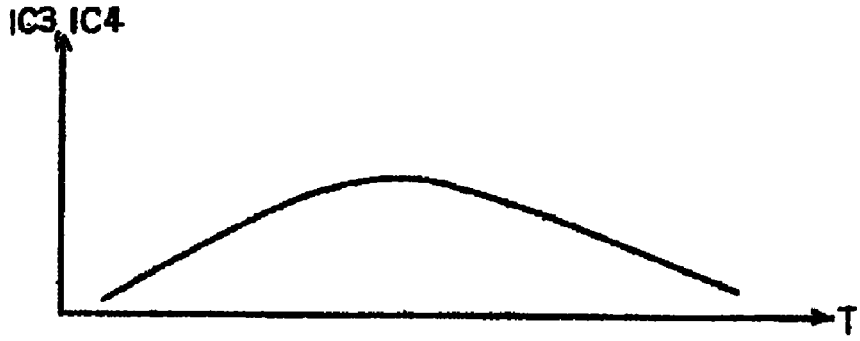
Figure 7D:
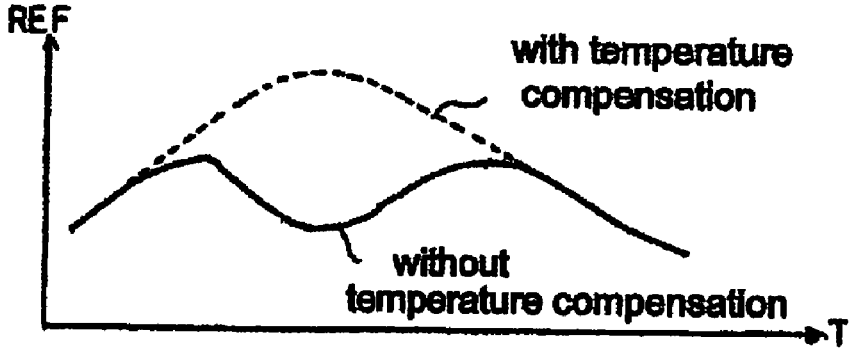

FIG. 6 is a view of a relationship between the current I41 and the current I45. Referring to FIG. 5 again, the current I41 flowing in the PMOS 41 is a temperature-proportional current as described in the first embodiment. Consequently, considering the relationship in FIG. 6, it is recognized that the current I45 has a peak value at a certain temperature. In addition, any temperature and any peak value can be set at the above peak point by selecting appropriately the resistance R42 of the resistor 42 and the dimension ratio K of the NMOSs 43 and 44. The above current I45 is copied by a current mirror configured of the PMOSs 45 and 46 and further copied by a current mirror configured of the PMOSs 47, 48 and 49. Subsequently, compensation currents IC3 and IC4 are generated in the NMOSs 48 and 49. The above compensation currents IC3 and IC4 are respective currents drawn from the nodes N1 and N2 of the band gap unit 10. Consequently, as shown in FIG. 7C, the largest compensation currents IC3 and IC4 can be drawn and the base-emitter voltage VBE of the PNPs 11 and 12 of the band gap unit 10 can be reduced when the output voltage REF has the peak value, and then the output voltage REF is reduced as shown by the solid lines in FIG. 7D.

As explained before, the temperature compensation unit of the third embodiment is configured to generate compensation current having a peak value at a certain temperature. By the above configuration, there is an advantage that temperature compensation can be carried out at lower temperatures as well higher temperatures, to compensate the temperature variation of the output voltage REF in wider temperature range, and precisely constant voltage can be obtained. In addition, since the configuration does not use NPNs, there is another advantage that the temperature compensation unit is of wider application.

FIG. 8 is a configuration of a temperature compensation unit according to a fourth embodiment of the invention. A temperature compensation unit 40A replaces the temperature compensation unit 20 in FIG. 1, and in the case of where the band gap unit 10 has curved temperature characteristics including a peak value, the temperature compensation unit 40A carries out temperature compensation for the band gap unit 10. In FIG. 8, the elements identical to the ones in FIG. 5 are provided with the same numerals as in FIG. 5, and description thereof is omitted.

The temperature compensation unit 40A in FIG. 8 includes PMOS 50 instead of the NMOSs 47 to 49 in FIG. 5. A source of the PMOS 50 is connected to power supply VDD, and a gate thereof is connected to a drain of the NMOS 44. In addition, drains of the PMOSs 46 and 50 are respectively connected to the nodes N1 and N2 of the band gap unit 10.

In the compensation unit 40A shown in FIG. 8, compensation current is applied to the nodes N1 and N2 of the band gap unit 10 in the opposite direction to the temperature unit 40 in FIG. 5. By the this above configuration, the base-emitter voltage VBE of the PNPs 11 and 12 of the band gap unit 10 can be increased by applying the largest compensation currents IC3 and IC4 thereto when the output voltage REF has a bottom value, and then the output voltage REF is increased. Consequently, there is a same advantage as in the third embodiment, by using the above temperature unit 40A when the band gap unit 10 has temperature characteristics including a bottom value.

The present invention should not be limited to the above-mentioned embodiments, and various modifications are possible. Examples of such modifications are as follows.

In the band gap unit 10, NPNs are used. However, the temperature compensation units 20, 20A, 40, 40A are applicable to circuits using band gap voltage of semiconductor elements such as diodes.

In the temperature compensation unit of the modification example shown in FIG. 9A, the PMOSs 34, 35, 36 and 37 can be serially inserted with respect to the current sources PMOSs 21, 28, 29 and 30, and a cascade structure applying bias voltage VB to gates of the above PMOSs 34 to 37 is applicable. By the above configuration, influences caused by variation of the supply voltage VDD can be reduced. Similarly, in the modification example shown in FIG. 9B, the temperature compensation unit includes serially inserted PMOSs 51-53.

The control voltage V10 obtained in the band gap voltage unit 10 is provided to the temperature compensation units 20, 20A, 40 and 40A in the various embodiments, to generate the temperature proportional current IPTAT proportional to absolute temperature. However, the control voltage V10 can be provided from other circuits that generate the temperature proportional current IPTAT proportional to absolute temperature.

What is claimed is:

1. A reference voltage circuit comprising:

a current source that outputs a reference voltage according to a control voltage, and that applies a current corresponding to the control voltage to first and second junction-type semiconductor devices;

a band gap unit including a differential amplifier that outputs the control voltage so that a voltage generated by a current flowing in the first junction-type semiconductor device becomes the same as a voltage generated by a current flowing in the second junction-type semiconductor device; and a temperature compensation unit that adds a compensation current proportional to absolute temperature generated according to the control voltage to the currents flowing in the first and second junction-type semiconductor devices, wherein the band gap unit has temperature characteristics having a peak value.

2. The reference voltage circuit of claim 1, wherein the first and second junction-type semiconductor devices are NPN-type bipolar transistors.

3. The reference voltage circuit of claim 1, wherein the first and second junction-type semiconductor devices are diodes.

4. The reference voltage circuit of claim 1, wherein said temperature compensation unit comprises:

a PMOS transistor having a control gate connected to the control voltage, a source connected to a power supply voltage, and a drain, the PMOS transistor providing a temperature proportional current responsive to the control voltage;

a bipolar transistor circuit connected between the power supply voltage and ground that provides a current proportional to a second power of the absolute temperature responsive to the temperature proportional current; and a current mirror that provides the compensation current responsive to the current proportional to the second power of the absolute temperature.

5. A reference voltage circuit comprising:

a current source that outputs a reference voltage according to a control voltage and that applies a current corresponding to the control voltage to first and second junction-type semiconductor devices;

a band gap unit including a differential amplifier that outputs the control voltage so that a voltage generated by a current flowing in the first junction-type semiconductor device becomes the same as a voltage generated by a current flowing in the second junction-type semiconductor device; and a temperature compensation unit that subtracts a compensation current proportional to absolute temperature generated according to the control voltage from the currents flowing in the first and second junction-type semiconductor devices, wherein the band gap unit has temperature characteristics having a bottom value.

6. The reference voltage circuit of claim 5, wherein the first and second junction-type semiconductor devices are NPN-type bipolar transistors.

7. The reference voltage circuit of claim 5, wherein the first and second junction-type semiconductor devices are diodes.

8. A reference voltage circuit comprising:

a current source that outputs a reference voltage according to a control voltage and that applies a current corresponding to the control voltage to first and second junction-type semiconductor devices;

a band gap unit including a differential amplifier that outputs the control voltage so that a voltage generated by a current flowing in the first junction-type semiconductor device becomes the same as a voltage generated by a current flowing in the second junction-type semiconductor device; and a temperature compensation unit that subtracts a compensation current proportional to absolute temperature generated according to the control voltage from the currents flowing in the first and second junction-type semiconductor devices, wherein the band gap unit has temperature characteristics having a peak value.

9. The reference voltage circuit of claim 8, wherein the first and second junction-type semiconductor devices are NPN-type bipolar transistors.

10. The reference voltage circuit of claim 8, wherein the first and second junction-type semiconductor devices are diodes.

11. A reference voltage circuit comprising:

a current source that outputs a reference voltage according to a control voltage and that applies a current corresponding to the control voltage to first and second junction-type semiconductor devices;

a band gap unit including a differential amplifier that outputs the control voltage so that a voltage generated by a current flowing in the first junction-type semiconductor device becomes the same as a voltage generated by a current flowing in the second junction-type semiconductor device; and a temperature compensation unit that adds a compensation current proportional to absolute temperature generated according to the control voltage to the currents flowing in the first and second first junction-type semiconductor devices, wherein the band gap unit has temperature characteristics having a bottom value.

12. The reference voltage circuit of claim 11, wherein the first and second junction-type semiconductor devices are NPN-type bipolar transistors.

13. The reference voltage circuit of claim 11, wherein the first and second junction-type semiconductor devices are diodes.

* * * * *